US008468989B2

(12) United States Patent
Waters et al.

(10) Patent No.: US 8,468,989 B2
(45) Date of Patent: Jun. 25, 2013

(54) METHOD FOR OPERATING A CAMSHAFT PHASER

(75) Inventors: James P Waters, Waterford, MI (US); Daniel G. Gauthier, Clarkston, MI (US)

(73) Assignee: Delphi Technologies, Inc., Troy, MI (US)

( * ) Notice: Subject to any disclaimer, the term of this patent is extended or adjusted under 35 U.S.C. 154(b) by 296 days.

(21) Appl. No.: 12/955,992

(22) Filed: Nov. 30, 2010

(65) Prior Publication Data

US 2012/0132165 A1 May 31, 2012

(51) Int. Cl.
*F01L 1/34* (2006.01)
*F02N 99/00* (2010.01)

(52) U.S. Cl.
USPC ..... 123/90.17; 123/179.3

(58) Field of Classification Search
USPC ..... 123/90.15–90.17, 179.3, 179.4
See application file for complete search history.

(56) References Cited

U.S. PATENT DOCUMENTS

| | | | | |
|---|---|---|---|---|
| 5,592,910 | A * | 1/1997 | Suga et al. | 123/90.17 |
| 5,893,345 | A * | 4/1999 | Sugimoto et al. | 123/90.17 |
| 6,530,351 | B2 * | 3/2003 | Mikame | 123/90.15 |
| 6,561,150 | B1 * | 5/2003 | Kikuoka et al. | 123/90.18 |
| 6,883,475 | B2 * | 4/2005 | Simpson | 123/90.15 |
| 7,584,728 | B2 | 9/2009 | Berndorfer | |
| 7,762,226 | B2 * | 7/2010 | Schafer et al. | 123/90.15 |
| 2001/0017114 | A1 * | 8/2001 | Mikame | 123/90.15 |
| 2006/0102125 | A1 * | 5/2006 | Mashiki | 123/179.4 |
| 2007/0185640 | A1 | 8/2007 | Pfeiffer et al. | |
| 2009/0025668 | A1 * | 1/2009 | Matsusaka et al. | 123/90.17 |
| 2009/0120392 | A1 * | 5/2009 | Takahashi et al. | 123/90.17 |
| 2009/0199807 | A1 * | 8/2009 | Schafer et al. | 123/90.15 |
| 2009/0276145 | A1 * | 11/2009 | Schafer et al. | 123/90.17 |
| 2010/0042306 | A1 | 2/2010 | Gauthier et al. | |
| 2010/0175649 | A1 * | 7/2010 | Suzuki et al. | 123/90.17 |
| 2011/0132307 | A1 * | 6/2011 | Patterson et al. | 123/179.3 |
| 2011/0290212 | A1 * | 12/2011 | Abboud et al. | 123/179.4 |
| 2012/0132164 | A1 * | 5/2012 | Waters et al. | 123/90.17 |
| 2012/0132165 | A1 * | 5/2012 | Waters et al. | 123/90.17 |

* cited by examiner

*Primary Examiner* — Stephen K Cronin
*Assistant Examiner* — Arnold Castro
(74) *Attorney, Agent, or Firm* — Thomas N. Twomey

(57) ABSTRACT

A method for operating a camshaft phaser in an internal combustion engine is provided. The camshaft phaser is used to control the phase relationship between a crankshaft and a camshaft of the internal combustion engine. The method includes determining that the internal combustion engine will be placed in an automatic stop mode. The camshaft phaser is then controlled to establish a predetermined phase relationship between the crankshaft and the camshaft. The internal combustion engine is then placed in automatic stop mode and the predetermined phase relationship is maintained by substantially blocking oil flow between the camshaft phaser and the internal combustion engine.

11 Claims, 6 Drawing Sheets

METHOD FOR OPERATING A CAMSHAFT PHASER

TECHNICAL FIELD OF INVENTION

The present invention generally relates to a camshaft phaser in an internal combustion engine. The present invention more particularly relates to a method for operating the camshaft phaser. The present invention most particularly relates to a method for operating the camshaft phaser in conjunction with an automatic stop mode of the internal combustion engine.

BACKGROUND OF INVENTION

Camshaft phasers, as are known in the art, are used to control the angular relationship of a pulley or sprocket of a crankshaft of an internal combustion engine to a camshaft of the internal combustion engine. The camshaft phaser allows changing the phase relationship of the crankshaft and camshaft while the engine is running. Typically, the camshaft phaser is used to shift an intake camshaft on a dual overhead camshaft engine in order to broaden the torque curve of the engine, to increase peak power at high revolution speeds, and to improve the idle quality. Also, an exhaust camshaft can be shifted by another camshaft phaser in order to provide internal charge dilution control, which can significantly reduce HC and NOx emissions, or to improve fuel economy. The above objectives are in the following briefly termed as combustion demands. With this definition, the camshaft phaser is used to account for combustion demands.

Camshaft phasers are commonly controlled by hydraulic systems which use pressurized lubrication oil from the engine in order to change the relative phase relationship between the camshaft and the crankshaft, thus altering the valve timing. An advance or retard position of the camshaft is commanded via an oil control valve. The oil control valve controls the oil flow to different ports entering a camshaft phaser, thus controlling the angular position of the camshaft relative to the pulley or sprocket of the crankshaft.

Camshaft phasers that are controlled by hydraulic systems typically include at least one lock pin for selectively maintaining a predetermined phase relationship between the crankshaft and the camshaft. When the camshaft phaser is used to control the phase relationship between the crankshaft and a camshaft used for opening and closing intake valves of the internal combustion engine, a lock pin is typically provided to maintain a default phase relationship that is fully retarded. However, in order to meet PZEV (partial zero evaporative emissions) it may be desired to selectively maintain a default phase relationship between the camshaft and the crankshaft that is intermediate of the full advance and full retard positions (mid-park) for higher compression and thus stronger improved cold start emissions. Hybrid vehicle architectures, however, re-start the internal combustion engine several times per drive mission. The stronger restart associated with the mid-park camshaft phaser position may be problematic because the aggressive re-start of the internal combustion engine may cause a disturbance to the driver and passengers of the motor vehicle while a more calm restart associated with the fully retarded camshaft phaser position is more desirable to avoid disturbing the driver and passengers of the motor vehicle. Additionally, the catalytic converter is typically hot enough when a hybrid vehicle is being restarted such that the emission system can absorb the emissions of a fully retarded intake camshaft phaser. Some camshaft phasers also include a second lock pin for maintaining the camshaft phaser in a full retard position because this phase relationship may be particularly useful for restarting the internal combustion engine under some conditions. However, the addition of a second lock pin adds additional complexity and cost to the camshaft phaser.

It is known that the efforts in the valve train may pressurize the oil contained in the chambers of the camshaft phaser such that the oil pressure inside the camshaft phaser reaches peaks which can be higher than the oil control supply pressure, i.e., the oil pressure supplied by the engine. This can lead to a certain amount of reverse oil flow across the oil control valve, thereby diminishing the phase rate performance of the camshaft phasing system.

To avoid the reverse oil flow under the above mentioned circumstances, recent approaches have proposed to employ a check valve integrated in the oil passage of any of the cylinder head, crankcase, camshaft phaser, or a manifold. Such a check valve also ensures that the camshaft phaser does not empty out in cases when the oil pressure is reduced, for example when the engine is stopped. However, this approach adds significant cost to the cylinder head, engine block, camshaft phaser, or manifold. Additionally, the implementation of the check valve can be difficult because of oil routing and the check valve may add an undesired restriction to the oil passage. Adding restriction may require the use of an oil pump larger than would otherwise be required, thereby decreasing the fuel efficiency of the internal combustion engine. Furthermore, the check valve should not be placed too far away from the camshaft phaser in order to remain effective. While some camshaft phasing systems have integrated a check valve directly within the camshaft phaser in order to maximize the effectiveness of the check valve, space within the camshaft phaser can be extremely limited, thereby making integration of the check valve within the camshaft phaser difficult.

U.S. Pat. No. 7,584,728; commonly assigned to Applicant and incorporated herein by reference in its entirety; teaches a strategy for controlling the oil control valve to avoid the reverse oil flow caused by efforts of the valve train while the internal combustion engine is running and without using a separate check valve. In this strategy, a spool of the oil control valve is synchronized to block ports when valve train efforts produce oil pressures within the camshaft phaser that are higher than oil pressure being supplied to the camshaft phaser from the oil source. In this way, a separate check valve is not needed in order to avoid the reverse oil flow while the internal combustion engine is operating. While this control strategy solves the problem of reverse oil flow while the engine is running, reverse oil flow may still occur when the engine is not running because the default position of the spool of the oil control valve provides fluid communication between the camshaft phaser and the oil source as well as between the camshaft phaser and a vent.

As an effort to conserve fuel, the internal combustion engine of some motor vehicles is automatically turned off, rather than allowing the internal combustion engine to idle, when the motor vehicle comes to a stop, for example, when the motor vehicle is stopped at a traffic light. This event may be known as automatic stop mode because the operator of the internal combustion engine has not turned off the ignition to the motor vehicle and various subsystems operate on battery power in anticipation of a near-term restart of the internal combustion engine. The internal combustion engine is then automatically restarted when propulsion is again desired which may be determined, for example, by the operator of the motor vehicle removing their foot from the brake pedal or applying pressure to the accelerator pedal. If such a motor vehicle uses the strategy of U.S. Pat. No. 7,584,728 to control the oil control valve rather than using a separate check valve, or if the mechanical check valve is located too far away from the camshaft phaser, oil pressure prime may be lost in the camshaft phaser each time the internal combustion engine is in automatic stop mode. This may be undesirable, for example, because camshaft phasing may not be available until sufficient time has been allowed to elapse after the internal combustion engine has been restarted in order to allow sufficient time to replenish oil to the camshaft phaser. The camshaft phaser may also produce an objectionable audible noise if pressure prime has been lost.

What is needed is a method for operating a camshaft phaser of an internal combustion engine when the internal combustion engine will be placed in an automatic stop mode without requiring a lock pin to maintain a predetermined phase relationship between a crankshaft and a camshaft of the internal combustion engine. What is also needed is a method for operating a camshaft phaser of an internal combustion engine when the internal combustion engine will be placed in an automatic stop mode which uses a spool of an oil control valve to maintain a predetermined phase relationship between a between a crankshaft and a camshaft of the internal combustion engine.

SUMMARY OF THE INVENTION

Briefly described, a method for operating a camshaft phaser in an internal combustion engine is provided. The camshaft phaser is used to control the phase relationship between a crankshaft and a camshaft of the internal combustion engine. An oil control valve having a spool disposed in a spool housing is provided for controlling the camshaft phaser. The oil control valve also includes a supply port for receiving pressurized oil from the internal combustion engine. The method includes determining that the internal combustion engine will be placed in an automatic stop mode. The camshaft phaser is then controlled to establish a predetermined phase relationship between the crankshaft and the camshaft. The internal combustion engine is then placed in automatic stop mode and the predetermined phase relationship is maintained by substantially blocking oil flow between the camshaft phaser and the internal combustion engine through the supply port.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

In the following description, for purposes of explanation and not limitation, specific details are set forth, such as particular embodiments, data flows, signaling implementations, interfaces, techniques, etc. in order to provide a thorough understanding of the present invention. However, detailed descriptions of well-known methods, interfaces, devices, and signaling techniques are omitted so as not to obscure the description of the present invention with unnecessary detail. Moreover, individual function blocks are shown in some of the figures. Those skilled in the art will appreciate that the functions may be implemented using individual hardware circuits, using software functioning in conjunction with a suitably programmed digital microprocessor or general purpose computer, such as an application specific integrated circuit (ASIC).

Figure 1:
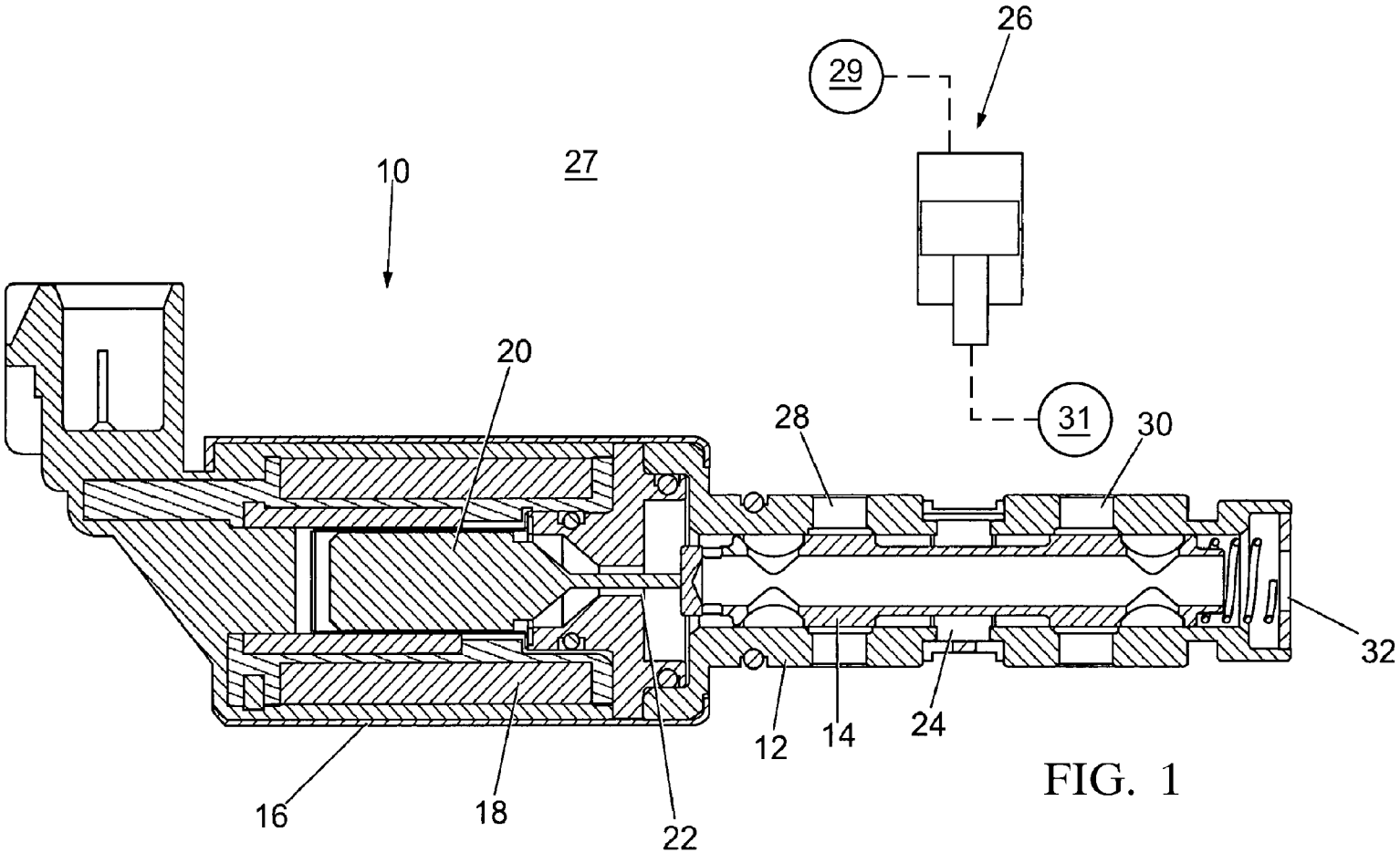
FIG. 1 is a sectional view of an oil control valve.

In accordance with a preferred embodiment of this invention and referring to FIG. 1, a sectional view of oil control valve 10 is shown. Oil control valve 10 includes spool housing 12, spool 14 slidably located within spool housing 12 and control unit 16 for controlling the position of spool 14 within spool housing 12. Control unit 16 includes coil 18 which is provided for affecting spool head (plunger) 20 which is combined with spool 14 by means of rod 22 extending in spool housing 12. Oil control valve 10 is provided for controlling oil flow from an oil supply channel (not shown) via oil supply port 24 into camshaft phaser 26 (portrayed only in schematically simplified form) of internal combustion engine 27. Camshaft phaser 26 controls the phase relationship between crankshaft 29 of internal combustion engine 27 and camshaft 31 of internal combustion engine 27 with the assistance of a crankshaft sensor (not shown) and a camshaft sensor (also not shown) as is taught in U.S. patent application Publication US 2007/0185640 A1 which is incorporated herein by reference in its entirety. Oil control valve 10 is generally mounted in a bore in the engine cylinder head (not shown) although other locations for oil control valve 10 are known such as within camshaft phaser 26 or within a manifold (not shown). Spool housing 12 of oil control valve 10, which is formed like a sleeve, includes as openings the above mentioned oil supply port 24 and furthermore first and second camshaft phaser ports 28, 30 and vent 32. Ports 24, 28, 30 cooperate with oil channels (not shown) arranged in the cylinder head. The oil flow through oil control valve 10 and these channels is essentially controlled by the position of spool 14 which is reciprocally mounted in spool housing 12. Positioning of spool 14 in spool housing 12 is controlled by control unit 16, which includes coil 18 functioning as a solenoid actuator.

The basic functionality of oil control valve 10, which is generally known in the art, is now briefly described in connection with FIG. 2, FIG. 3, and FIG. 4 and FIG. 5.

Figure 2:
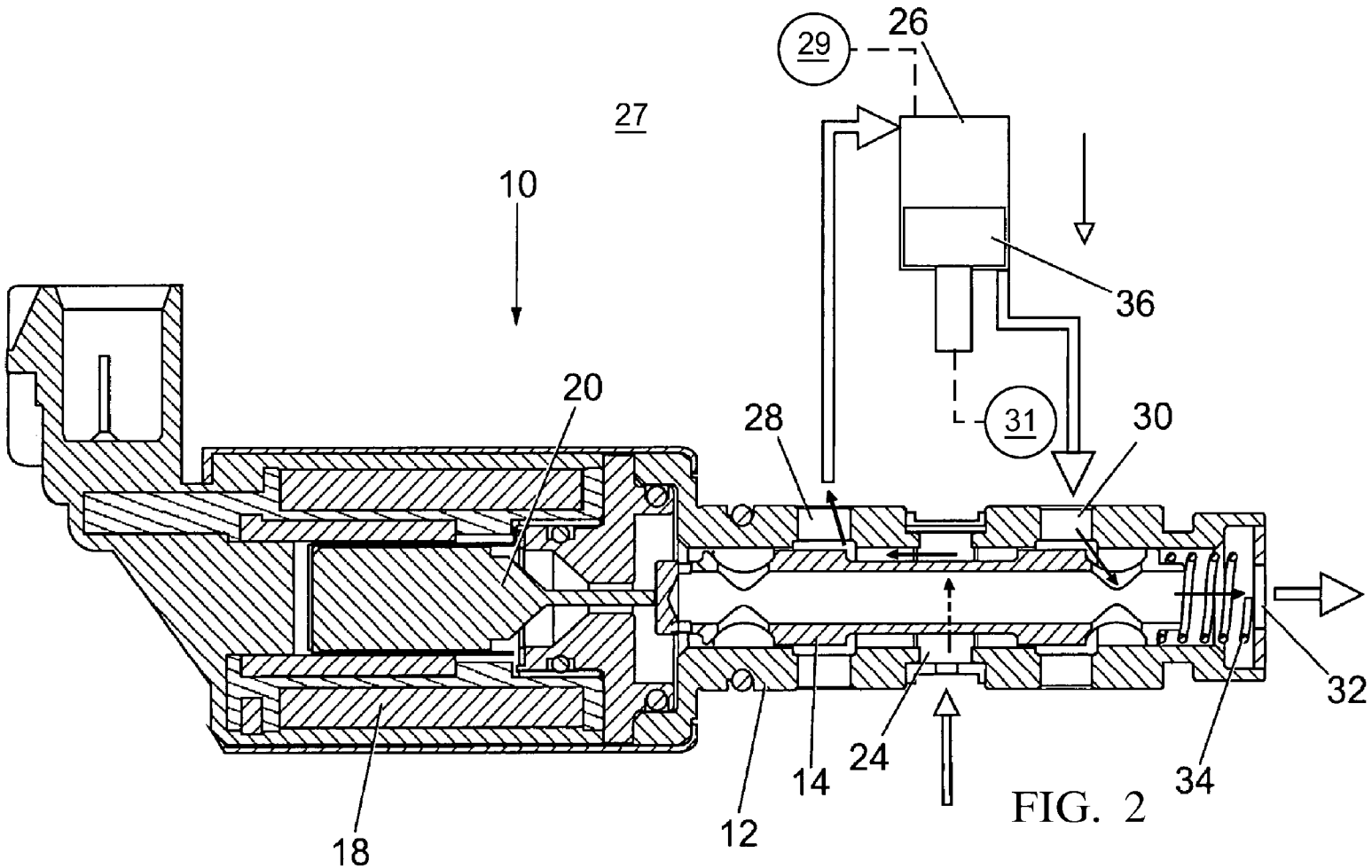
FIG. 2 is a sectional view of a de-energized oil control valve with a spool comprised in the oil control valve being shifted into a first extreme position.

FIG. 2 shows a situation, where oil control valve 10 is de-energized, i.e. where coil 18 is de-energized and therefore no electric current is being applied thereto, resulting in spool 14 being shifted by means of spring 34 into a first extreme position or uppermost position. In this position of spool 14, all ports 24, 28, 30 are open, allowing supply oil to enter spool housing 12 via oil supply port 24 and being fed via first camshaft phaser port 28 to camshaft phaser 26. The oil received at camshaft phaser 26 moves piston 36 included in camshaft phaser 26. Oil, which was contained in camshaft phaser 26 prior to oil being fed via first camshaft phaser port 28 to camshaft phaser 26 is now thrust out of camshaft phaser 26 and enters and leaves spool housing 12 via second camshaft phaser port 30 and vent 32, respectively. The position of spool 14 portrayed in FIG. 2 causes camshaft phaser 26 to move "full stroke" which may be the full advance phase relationship.

Figure 3:
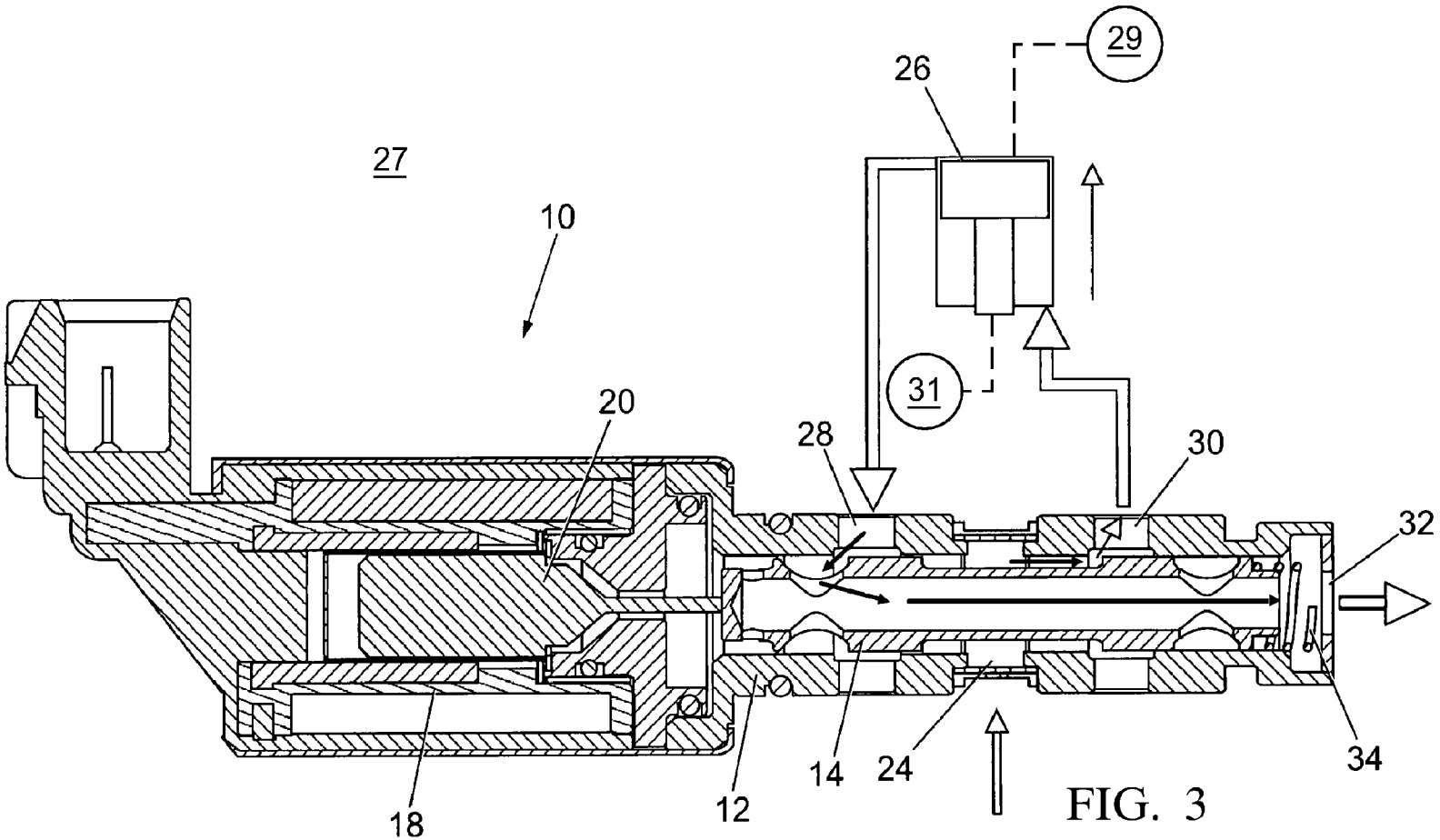
FIG. 3 is a sectional view of an energized oil control valve with a spool being shifted into a second extreme position.

Now referring to FIG. 3, a situation is shown where oil control valve 10 is fully energized and where spool 14 is, against the spring force of spring 34, forced into a second extreme position or lowermost position by means of solenoid actuator 18, 20, i.e. by means of energizing coil 18 included in control unit 16 with an electric current sufficient in magnitude to displace spool 14 into the second extreme position. In the lowermost position of spool 14, oil supply port 24 is also open and thus allows oil to enter spool housing 12. However, contrary to the situation portrayed in FIG. 2, the lowermost position of spool 14 now connects oil supply port 24 with second camshaft phaser port 30 and thus results in oil being fed to camshaft phaser 26 in a way which causes the camshaft phaser 26 to "move full stroke opposite direction" which may be the full retard phase relationship. Oil thrust out of camshaft phaser 26 enters and leaves spool housing 12 via first camshaft phaser port 28 and vent 32 respectively.

With spool 14 being either in the uppermost or lowermost position, one of the camshaft phaser ports 28, 30 is open for feeding oil to camshaft phaser 26 and the other one of camshaft phaser ports 28, 30 is open for receiving oil from camshaft phaser 26. However, even when feeding oil to camshaft phaser 26, a situation might occur due to efforts in the valve train, where the pressure in the respective reservoir of camshaft phaser 26, might exceed the supply oil pressure. An unbalance in pressure on the receiving side, i.e. the pressure in the respective reservoir of camshaft phaser 26, and the pressure on the supply side, i.e. the pressure in the supply oil pressure, causes reverse flow which is detrimental to the phase rate of camshaft phaser 26. In order to overcome reverse flow, prior approaches have proposed to employ check valves such as check valve 13. The method of U.S. Pat. No. 7,584,728; however; does not rely on a separate check valve to prevent reverse flow. Rather, the method proposes to utilize the spool 14 to prevent reverse flow, as will be described below in connection with FIG. 4 which shows spool 14 in the same position as in FIG. 1, but is included to show the lack of fluid communication between oil control valve 10 and camshaft phaser 26 compared to the fluid communication shown in FIGS. 2 and 3.

Figure 4:
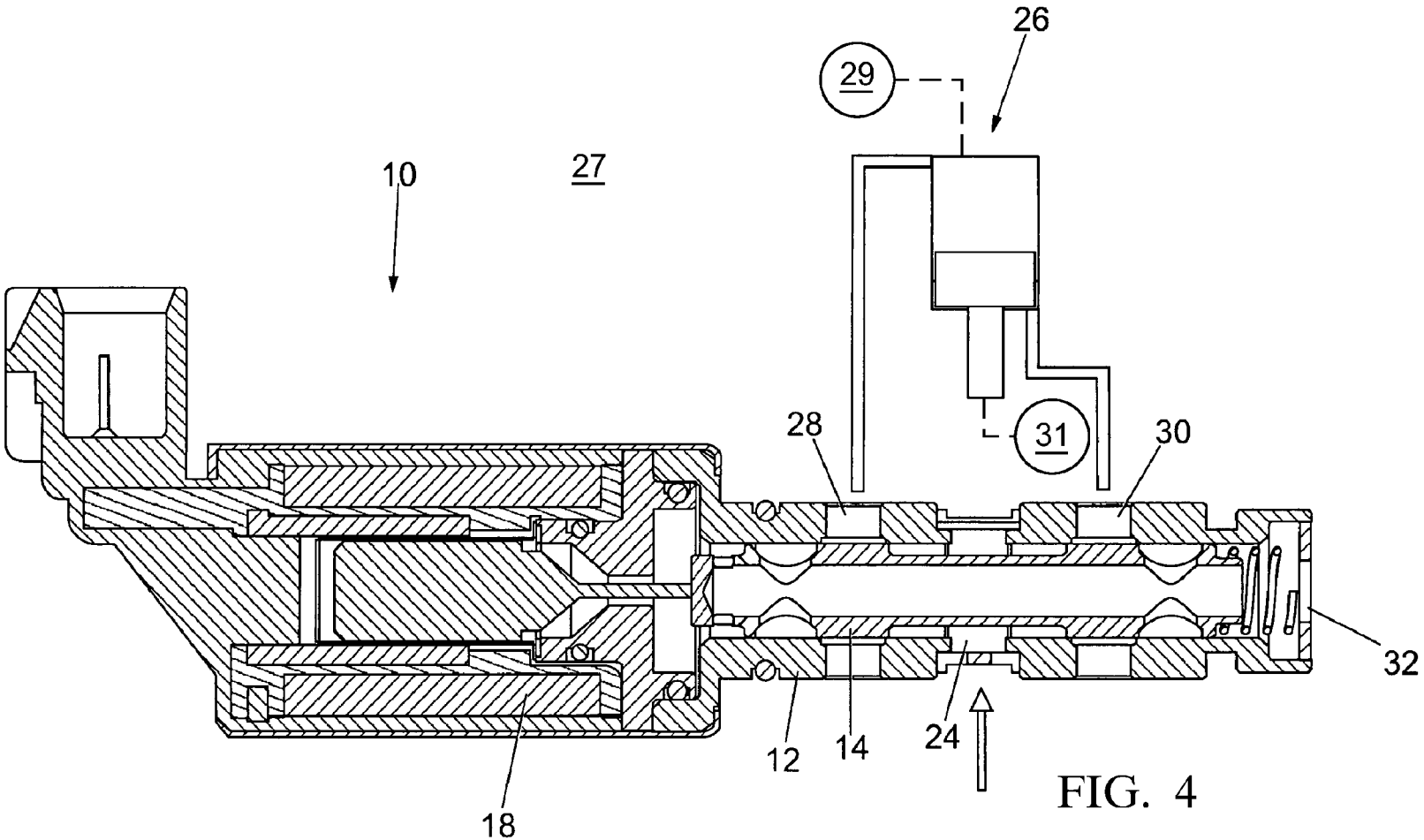
FIG. 4 is a sectional view of an oil control valve in an intermediate position.

The method of U.S. Pat. No. 7,584,728 teaches to synchronize the displacement of spool 14 in spool housing 12 not only with combustion demands, but also with oil pressure characteristics on the output side, i.e. extending from the first and second camshaft phaser ports 28, 30 onwards, of oil control valve 10. Accordingly, FIG. 4 shows oil control valve 10 in a partly energized situation, where partly energized refers to feeding a predetermined electric current, for example, 50% of the current through coil 1, as opposed to the fully energized situation (FIG. 3) where a full electric current, for example, 100% of the electric current would be fed through coil 18 causing spool 14 to be disposed into the lowermost or extreme position. Partly energizing coil 18 causes spool 14 to be held in a fixed intermediate position, i.e. in a position between the uppermost and lowermost position. In the intermediate position, all ports 24, 28, 30, i.e. oil supply port 24 and first and second camshaft phaser ports 28, 30, are blocked. With both first and second camshaft phaser ports 28, 30 being blocked, vent 32 is also blocked. With all ports 24, 28, 30 blocked, substantially no oil can enter oil control valve 10 from either direction, i.e. supply oil substantially cannot enter oil control valve 10 due to blocked oil supply port 24 and oil from camshaft phaser 26 cannot enter oil control valve 10 due to blocked first and second camshaft phaser ports 28, 30. All ports 24, 28, 30 being blocked also results in camshaft phaser 26 being held in a fixed position. In this way, a change in phase relationship between crankshaft 29 and camshaft 31 may be substantially prevented.

Figure 5:
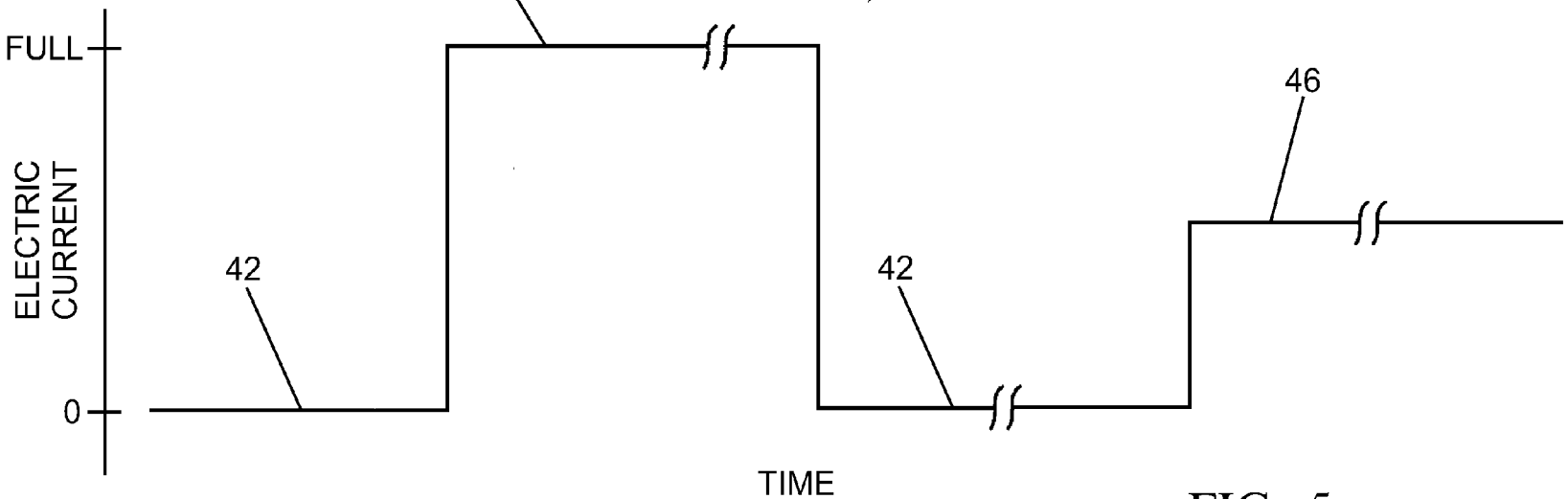
FIG. 5 is a plot of time versus current showing the current supplied for each of the positions of the control valve shown in FIG. 2, FIG. 3, and FIG. 4.

Now referring to FIG. 5, a plot 40 is shown representing time versus current supplied to coil 18 which yields the positions of spool 14 within spool housing 12 shown in FIG. 2, FIG. 3, and FIG. 4. Sections 42 of plot 40 represent situations where no electric current is supplied to coil 18, thereby resulting in spool 14 being positioned in the first extreme position or upper most position as shown in FIG. 2. Section 44 of plot 40 represents a situation where full electric current is supplied to coil 18, thereby resulting in spool 14 being positioned in the second extreme position or lower most position as shown in FIG. 3. Section 46 of plot 40 represents a situation where internal combustion engine 27 is in automatic stop mode and a predetermined electric current, which is less than full electric current, is supplied to coil 18, thereby resulting in spool 14 being positioned in the fixed intermediate position as shown in FIG. 4.

Spool 14 may be moved to the intermediate position (FIG. 4) when internal combustion engine 27 is in automatic stop mode, or otherwise temporarily not running, in order to block oil flow between camshaft phaser 26 and internal combustion engine 27 to prevent reverse flow of oil. When internal combustion engine 27 is placed in an automatic stop mode, the predetermined electric current is supplied to coil 18 to position spool 14 within spool housing 12 to block all ports 24, 28, 30. In this way, oil is retained within camshaft phaser 26 while internal combustion engine 27 is in automatic stop mode. The ability to retain oil within camshaft phaser 26 while internal combustion engine 27 is in automatic stop mode will in some circumstances decrease the time it takes to be able to change the phase relationship between crankshaft 29 and camshaft 31 when internal combustion engine 27 has been restarted because the oil prime does not need to be restored to camshaft phaser 26. Additionally, the ability to block all ports 24, 28, 30 while internal combustion engine 27 is in automatic stop mode substantially prevents a change in phase relationship between crankshaft 29 and camshaft 31 while internal combustion engine 27 is in automatic stop mode.

Figure 6:
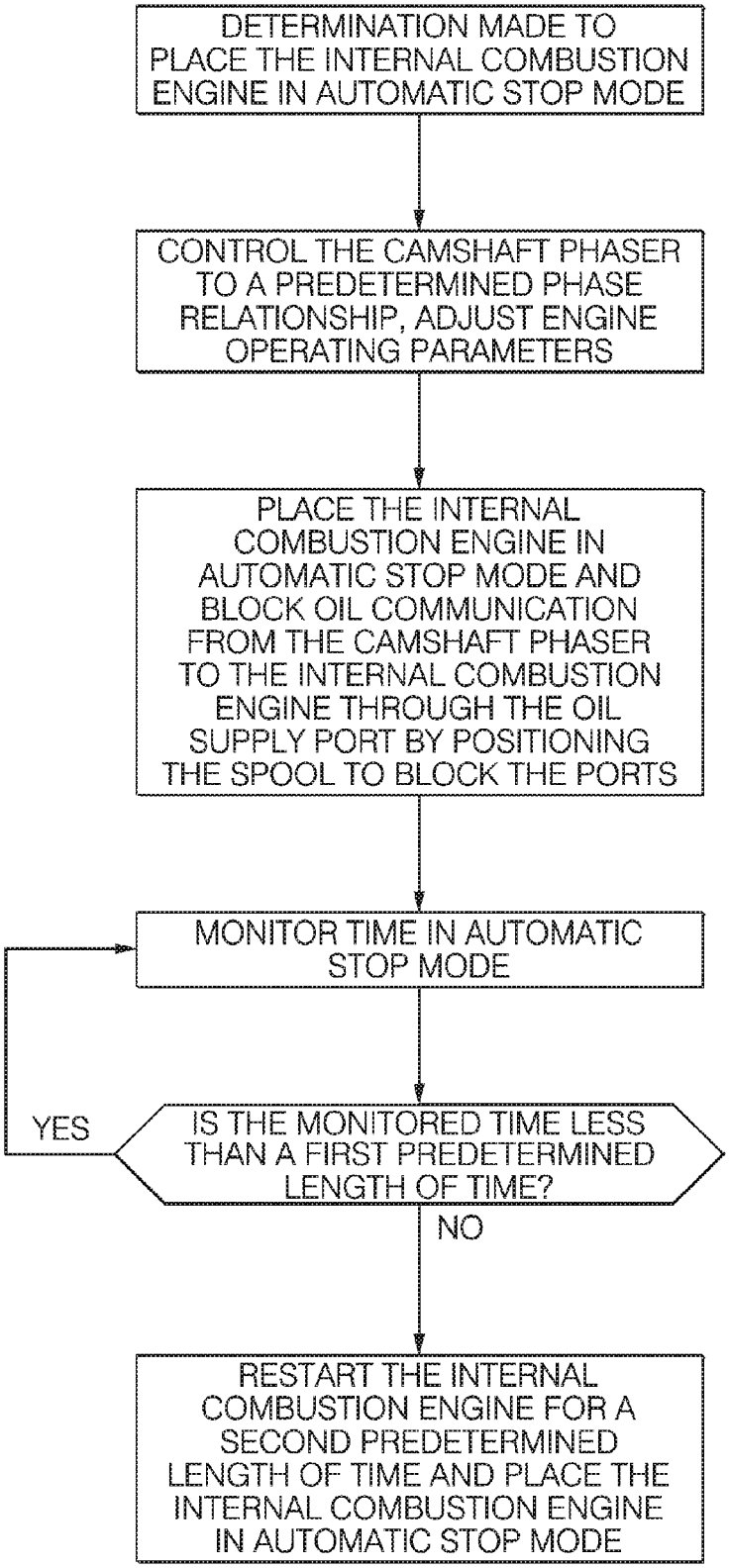
FIG. 6 is a flow diagram of a method of operating a camshaft phaser in accordance with the present invention.

Now referring to FIG. 6, when a determination has been made to place internal combustion engine 27 in automatic stop mode, camshaft phaser 26 may be controlled to establish a predetermined phase relationship between crankshaft 29 and camshaft 31 that is beneficial to aid in restarting internal combustion engine 27. This predetermined phase relationship can be maintained while internal combustion engine 27 is in automatic stop mode by blocking oil flow from camshaft phaser 26 to internal combustion engine 27 through oil supply port 24. This may be accomplished by blocking ports 24, 28, 30 as described above by supplying the predetermined electric current to coil 18.

The predetermined phase relationship for camshaft phaser 26 affecting the phase relationship of a camshaft 31 used to open and close intake valves (not shown) of internal combustion engine 27 may be the full retard position. The full retard position may provide a level of torque sufficient to ensure a restart of internal combustion 27 upon command while not providing excess torque that may be objectionable to the operator of the motor vehicle. In this way, a smooth transition from automatic stop mode to engine running may be provided. FIG. 4 shows camshaft phaser 26 in the full retard position and spool 14 blocking ports 24, 28, 30.

If camshaft phaser 26 is controlled to the predetermined phase relationship in anticipation of internal combustion engine 27 being placed in automatic stop mode, the engine may not operate as desired prior to being placed in automatic stop mode. For example, the torque output of the internal combustion engine may be reduced when camshaft phaser 26 is controlled to the predetermined phase relationship. In order to maintain desired operation of internal combustion engine 27, one or more engine operating parameters may need to be adjusted in order to accommodate for camshaft phaser 26 being controlled to the predetermined phase relationship. Adjusting one or more engine operating parameters, for example, quantity of fuel supplied to internal combustion engine 27, timing of spark for ignition of fuel, or quantity of air supplied to internal combustion engine 27 may ensure that internal combustion engine 27 operates as desired prior to entering automatic stop mode. More specifically, additional fuel may be supplied to internal combustion engine 27, the timing of spark may be advanced, or the quantity of air supplied to internal combustion engine 27 may be increased.

After internal combustion engine 27 has been placed in automatic stop mode, ports 24, 28, 30 are blocked as described previously, thereby substantially preventing a change in phase relationship between crankshaft 29 and camshaft 31. Of course, ports 24, 28, 30 may be blocked prior to internal combustion engine 27 being placed in automatic stop mode. Even though ports 24, 28, 30 are blocked, over time, small amounts of oil may leak through ports 24, 28, 30. Given sufficient time, enough oil may leak through ports 24, 28, 30 that forces, for example from valve springs (not shown) of internal combustion engine 27, may change the phase relationship between crankshaft 29 and camshaft 31. In order to prevent this change in phase relationship, internal combustion engine 27 may be started for a period of time that is sufficient to replenish oil pressure to camshaft phaser 26. More specifically, the length of time internal combustion engine 27 is in automatic stop mode may be monitored. After a first predetermined length of time has elapsed which corresponds to the length of time internal combustion engine 27 has been in automatic stop mode, internal combustion engine 27 may be restarted for a second predetermined length of time that is sufficient to replenish oil pressure to camshaft phaser 26. The first predetermined length of time may be determined in part by the temperature of the oil because cooler oil has a higher viscosity than warmer oil and therefore cooler oil will take a longer time to leak through ports 24, 28, 30. After oil pressure has been replenished to camshaft phaser 26, internal combustion engine 27 may resume automatic stop mode.

It is estimated that the electric load impact of the method of this invention is about 0.75 amps for each camshaft phaser when internal combustion engine 27 is in automatic stop mode. However, this electric load may be insignificant when compared to other electrical loads that are supplied to various subsystems when the internal combustion engine is in automatic stop mode, for example lighting and HVAC (heating, ventilation, air conditioning).

While this invention has been described in terms of maintaining the predetermined phase relationship by blocking ports 24, 28, 30 via supplying the predetermined electric current to coil 18, it should now be understood that a conventional mechanical check valve could be used instead. When performing the method of the present invention with a mechanical check valve (not shown), the mechanical check valve prevents oil from flowing from camshaft phaser 26 to internal combustion engine 27 through oil supply port 24. Even though there may be fluid communication between camshaft phaser 26 and vent 32 when a mechanical check valve is used, the remaining oil that is trapped within camshaft phaser 26 is sufficient to maintain the predetermined phase relationship.

While this invention has been described in terms of the preferred embodiments thereof, it is not intended to be so limited, but rather only to the extent set forth in the claims that follow.

We claim:

1. A method for operating a camshaft phaser in an internal combustion engine, said camshaft phaser being provided for controlling the phase relationship between a crankshaft and a camshaft of said internal combustion engine, said camshaft phaser being provided with an oil control valve have having a spool disposed in a spool housing for controlling said camshaft phaser and having a supply port for receiving pressurized oil from said internal combustion engine, said method comprising:

determining that said internal combustion engine will be placed in an automatic stop mode;

controlling said camshaft phaser to establish a predetermined phase relationship between said crankshaft and said camshaft after said determining step;

placing said internal combustion engine in said automatic stop mode after said positioning step; and maintaining said predetermined phase relationship by substantially blocking oil flow between said camshaft phaser and said internal combustion engine through said supply port.

2. The method of claim 1 wherein said substantially blocking includes positioning said spool within said spool housing to substantially block oil flow between said camshaft phaser and said internal combustion engine after said controlling step.

3. The method of claim 2 wherein said positioning includes energizing a solenoid of said oil control valve with a predetermined electric current.

4. The method of claim 1 further comprising monitoring a length of time said internal combustion engine is in said automatic stop mode.

5. The method of claim 4 further comprising restarting said internal combustion engine if said length of time exceeds a first predetermined length of time.

6. The method of claim 5 further comprising placing said internal combustion engine in said automatic stop mode after said internal combustion engine has been running for a second predetermined length of time.

7. The method of claim 5 wherein said first predetermined length of time is based on a temperature of said pressurized oil.

8. The method of claim 1 wherein said camshaft opens and closes intake valves of said internal combustion engine.

9. The method of claim 8 wherein said predetermined phase relationship is a full retard position.

10. The method of claim 1 further comprising adjusting engine operating parameters prior to placing said internal combustion engine in said automatic stop mode in order to provide continuous engine torque.

11. The method of claim 10 wherein said parameters are selected from the group of quantity of fuel, timing of spark, and volume of air.

* * * * *